United States Patent [19]

Granberg

[11] Patent Number: 4,599,066

[45] Date of Patent: Jul. 8, 1986

[54] RADIANT ENERGY BURNER

[75] Inventor: Dirk N. Granberg, Brookfield, Wis.

[73] Assignee: A. O. Smith Corp., Milwaukee, Wis.

[21] Appl. No.: 792,165

[22] Filed: Oct. 25, 1985

Related U.S. Application Data

[63] Continuation of Ser. No. 580,686, Feb. 16, 1984, abandoned.

[51] Int. Cl.[4] ..... F23D 14/14

[52] U.S. Cl. ..... 431/329; 431/260

[58] Field of Search ..... 431/326, 328–329, 431/260; 126/91 A, 92 AC, 92 C

[56] References Cited

U.S. PATENT DOCUMENTS

| | | | |
|---|---|---|---|
| 444,850 | 1/1891 | Reed . | |
| 3,087,484 | 4/1963 | Eddy | 431/329 |
| 3,179,156 | 4/1965 | Weiss et al. | 158/116 |
| 3,199,573 | 8/1965 | Flynn | 431/329 |
| 3,208,247 | 9/1965 | Weil et al. | 67/88 |
| 3,269,449 | 8/1966 | Witten | 431/328 |
| 3,275,497 | 9/1966 | Weiss et al. | 162/103 |
| 3,383,159 | 5/1968 | Smith, Jr. | 431/7 |
| 3,485,230 | 12/1969 | Harrington et al. | 431/329 X |
| 3,804,163 | 4/1974 | Bradley et al. | 431/328 X |
| 3,833,338 | 9/1974 | Badrock | 431/328 |
| 3,857,669 | 12/1974 | Smith et al. | 431/328 |
| 4,189,297 | 2/1980 | Bratko et al. | 431/328 |
| 4,255,123 | 3/1981 | Bishilany et al. | 431/328 |

FOREIGN PATENT DOCUMENTS

| | | | |
|---|---|---|---|
| 703256 | 2/1965 | Canada | 431/329 |
| 0155012 | 9/1982 | Japan | 431/329 |
| 7808335 | 3/1979 | Netherlands | 431/329 |

OTHER PUBLICATIONS

Letter from Acurex Corporation to A. O. Smith Corporation, 2-24-82.

3M Corporation, Brochure "Nextel 312 Ceramic Fibers.

*Primary Examiner*—Margaret A. Focarino

[57] ABSTRACT

A radiant energy burner having a combustion element composed of a generally cylindrical foraminous metal support or screen, and a woven fabric formed of substantially continuous ceramic fibers is disposed on the outer surface of the support. The end portions of the fabric are connected to the support while the portion of the fabric located between the connected end portions is free of attachment to the support. A blower is used to supply a gaseous fuel mixture through the support and fabric and an igniter is located on the outer surface of the fabric to ignite the fuel mixture on the outer surface of the fabric.

5 Claims, 3 Drawing Figures

FIG. 1
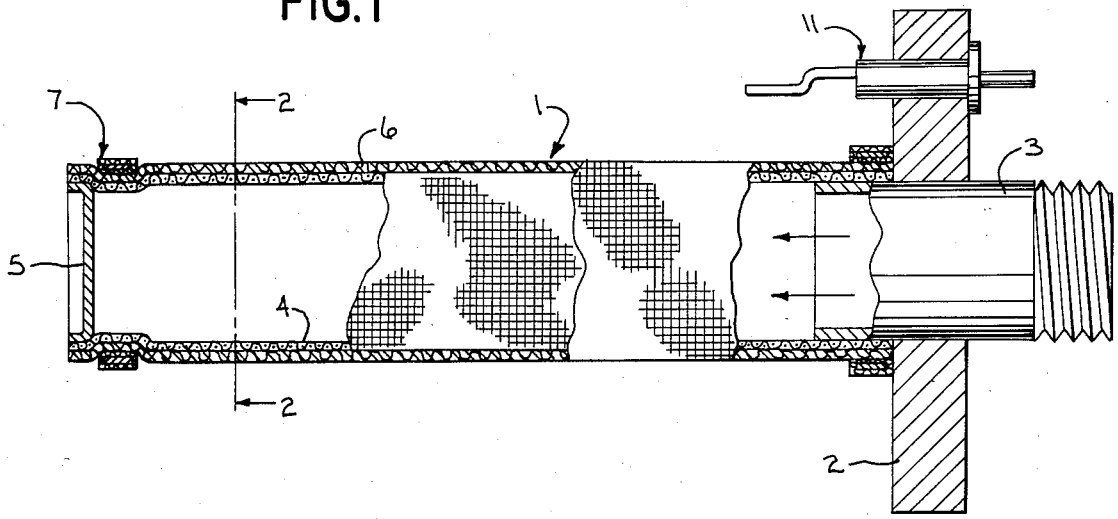
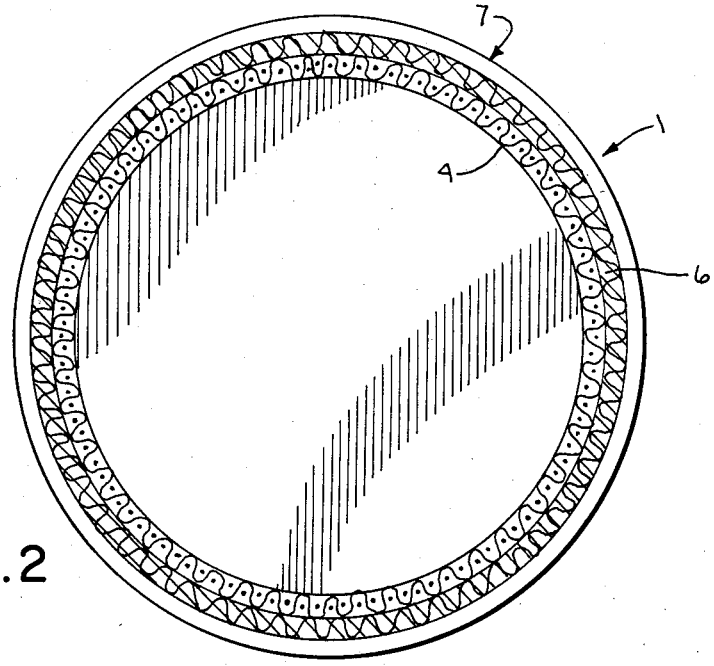
FIG. 2
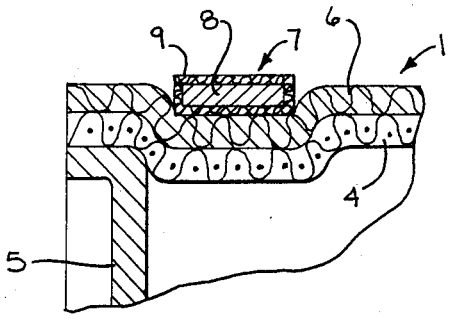
FIG. 3

RADIANT ENERGY BURNER

This is a continuation of application Ser. No. 06/580,686, filed Feb. 16, 1984, and now abandoned.

BACKGROUND OF THE INVENTION

Radiant energy burners employ a combustion element which is permeable to the gaseous fuel and the fuel is burned in a flameless type of combustion on the outer surface of the element to principally emit radiant energy. In burners of this type, it is important to control the porosity and back pressure of the combustion element in order to obtain the proper combustion efficiency and minimize the possibility of "blowback" or flame lifting from the surfce of the burner.

In the past, a form of radiant combustion element has consisted of an inner metal screen covered with a layer of randomly disposed short ceramic fibers. Elements of this type have been produced by immersing the screen in a molding tank containing a liquid slurry of the ceramic fibers and then drawing a vacuum through the screen, with the result that the fibers are deposited as a layer on the screen. The resulting vacum-formed layer of ceramic fibers is fragile and is highly susceptible to damage during shipment and handling.

During use, the short fibers in the vacuum formed layer tend, with time, to dissociate which results in the combustion element having a non-uniform porosity, thereby decreasing the efficiency of the combustion and the useful life of the burner.

Furthermore, if the vacuum formed fibrous coating is broken away, either by damage or during usage, an outage can result in which a flame sensor will shut down the system due to a significant change in combustion pattern. While an outage is not a dangerous situation, it is a nuisance problem.

To provide protection for the fragile vacuum formed coating, attempts have been made in the past to enclose the combustion element in an outer protective sleeve, such as described in U.S. Pat. No. 3,275,497 and 3,179,156. However, the use of an outer protective screen substantially reduces the efficiency of the radiant heating operation and adds unnecessary cost.

SUMMARY OF THE INVENTION

The invention is directed to a radiant energy burner having an improved combustion element. In the preferred form, the combustion element comprises a generally cylindrical metal screen or support, and a woven fabric sleeve composed of continuous ceramic fibers is disposed around the screen. The ends of the sleeve are secured to the metal support, while the central portion of the sleeve is free of attachment. In use, a blower supplies a gaseous fuel mixture to the interior of the cylindrical support and the mixture flows outwardly through the support and fabric where it is combusted on the outer surface of the fabric to emit primarily a radiant form of energy.

As the woven ceramic fabric is flexible and not brittle, the combustion element is extremely durable and can be handled without damage.

Because the fabric is composed of continuous fibers, there is no loss of fibrous content during usage, with the result that useful life is prolonged. Also, the porosity of the fabric will remain substantially the same during service which enhances uniform combustion.

The woven fabric is available in different grades to obtain the desired porosity depending upon the particular application or use.

As the woven fabric is not secured throughout its length to the metal support, but only at its end portions, the difference in coefficient of expansion between the fabric and the metal screen is not a life limiting factor. The fabric is capable of compensating for the greater expansion of the screen at elevated temperatures. This is a substantial improvement over a vacuum formed ceramic layer which is attached throughout its length to the supporting metal screen. In this latter system, due to the difference in coefficient of expansion between the two materials, stresses can be set up in the vacuum formed coating causing cracking and rupture of the coating.

Other objects and advantages will appear in the course of the following description.

DESCRIPTION OF THE DRAWINGS

The drawings illustrate the best mode presently contemplated of carrying out the invention.

In the drawings:

FIG. 1 is a side elevation of the combustion element for a radiant energy heater with parts broken away in section;

FIG. 2 is a transverse section taken along line 2—2 of FIG. 1; and

FIG. 3 is a fragmentary enlarged section showing the connection of the fabric sleeve to the metal support.

DESCRIPTION OF THE ILLUSTATED EMBODIMENT

FIG. 1 illustrates a combustion element 1 to be used in a radiant energy burner. The combustion element includes a mounting flange 2 which is adapted to be connected to a suitable supporting structure or housing and is attached to inlet conduit 3. A generally cylindrical foraminous metal support or screen 4 is secured around the end of conduit 3 and extends outwardly from mounting flange 2. An end closure 5 is secured within the outer end of the cylindrical screen 4 to close off the outer end.

In accordance with the invention, a woven fabric sleeve 6 is located around the screen 4. Sleeve 6 is formed of continuous ceramic fibers capable of withstanding temperatures in excess of 1800° F. As an example, the sleeve 6 can be woven from ceramic fibers sold under the name of Nextel (3M Company) which are continous polycrystalline metal oxide fibers, with the metal oxides consisting by weight, of 62% aluminum oxide, 14% boron oxide, and 24% silicon dioxide.

The ends of sleeve 6 are connected to the screen 4 by connecting assemblies indicated by 7. Each connecting assembly 7 includes a conventional metal strap 8 which is located within a ring-like sleeve of ceramic fabric 9. The sleeve 9 can be composed of the same material as the sleeve 6.

The ring-like sleeve 9 is provided with an opening and the free end of the tie strap 8 extends through the opening. After the tie strap 8 is firmly clamped to sleeve 6 the projecting end of the tie strap can be severed at the location of the opening in the sleeve 9 so that the end of the tie strap is not exposed. This type of connecting assembly 7 eliminates direct contact between the metal tie strap 8 and the fabric sleeve 6 and thus minimizes wear of sleeve 6 as the screen and sleeve expand during usage. Furthermore, the outer layer of the ring-like sleeve 9 protects the metal tie strap 8 against the high temperatures generated during use of the burner.

As best shown in FIG. 3, the connecting assembly 7 located at the outer end of screen 4, adjacent end closure 5, is positioned within a groove 10 in the screen 4.

The gaseous fuel mixture, which can be a mixture of a gas, such as natural gas, propane or the like, and air is introduced into the interior of the screen 4 through inlet conduit 3 by a blower which provides the necessary pressure to force the gaseous fuel mixture through the fabric sleeve 6.

The fuel is ignited on the outer surface of sleeve 6 by a standard igniter unit 11. The result is a flameless type of combustion on the outer surface of the woven fabric sleeve 6 which principally results in the emmision of radiant energy.

The radiant burner of the invention can be used in a wide variety of applications, such as space heaters, furnaces, water heaters, and the like. When used with a water heater, the radiant burner would be enclosed within a heating chamber, so that it is not in direct contact with the water to be heated.

The woven ceramic fabric, being a flexible material, provides an extremely durable combustion element which eliminates the problems encountered with the vacuum formed combustion elements, as used in the past.

As a further advantage, the fabric being formed from continuous fibers, eliminates the loss of fibrous content during use with the result that the porosity of the fabric will be maintained substantially uniform during service.

As the sleeve is attached only to the metal suppot at its end portions, the metal support or screen can move or expand relative to the fabric when exposed to elevated temperatures. This is a substantial improvement over the vacuum formed fibrous element in which the fibrous layer is bonded throughout its length to the support. Due to the substantial difference in coefficient of expansion between the ceramic fiber material and the underlying metal support in the vacuum formed element, stresses are set up in the fibrous coating which can result in cracking and ultimate rupture.

Various modes of carrying out the invention are contemplated as being within the scope of the following claims particularly pointing out and distinctly claiming the subject matter which is regarded as the invention.

I claim:

1. In a radiant energy burner, a combustion element comprising a porous metal support having an inner surface and an outer surface, a woven fabric disposed on the outer surface of said support and composed of substantially continuous ceramic fibers, connecting means for securing end portions of said fabric to said support, said connecting means being metal and being enclosed in a ring-like sleeve of woven ceramic fiber, the central portion of said fabric being free of attachment to said support, supply means including a blower to supply a gaseous fuel through said support and said fabric, and fuel igniting means disposed adjacent to the outer surface of the fabric to ignite said fuel.

2. The burner of claim 1, wherein said metal support is generally cylindrical in shape and said fabric is a cylindrical sleeve disposed around said support.

3. The burner of claim 2, wherein said connecting means comprises a ring-like connecting member connecting each end of said sleeve to said support.

4. In a radiant energy burner, a combustion element comprising a generally cylindrical foraminous metal support having an inner end and an outer end, a closure enclosing the outer end of said support, a flexible woven fabric sleeve composed solely of substantially continuous polycrystalline metal oxide fibers disposed on the outer surface of said support and extending substantially the full length of said support, one end of said support having a circumferential groove, said sleeve being attached in said groove, supply means communicating with the inner end of said support and including a blower for supplying a gaseous fuel mixture to the interior of said support, said fuel mixture flowing outwardly through said support and said fabric sleeve, and fuel igniting means disposed adjacent the outer surface of said sleeve to ignite said fuel.

5. The burner of claim 4, wherein said fibers are composed of 62% by weight of aluminum oxide, 14% by weight of boron oxide and 25% by weight of silicon dioxide.

* * * * *